US007131406B2

(12) United States Patent
Dürr et al.

(10) Patent No.: US 7,131,406 B2
(45) Date of Patent: Nov. 7, 2006

(54) TWO-CYCLE ENGINE HAVING SCAVENGING

(75) Inventors: Bernhard Dürr, Stuttgart (DE); Harald Schliemann, Waiblingen (DE); Jörg Schlossarczyk, Winnenden (DE); Werner Geyer, Berglen (DE)

(73) Assignee: Andreas Stihl AG & Co. (DE)

( * ) Notice: Subject to any disclaimer, the term of this patent is extended or adjusted under 35 U.S.C. 154(b) by 217 days.

(21) Appl. No.: 10/347,741

(22) Filed: Jan. 17, 2003

(65) Prior Publication Data

US 2003/0136360 A1 Jul. 24, 2003

(30) Foreign Application Priority Data

Jan. 19, 2002 (DE) ..... 102 01 967

(51) Int. Cl.
*F02B 25/14* (2006.01)

(52) U.S. Cl. ..... 123/65 P; 123/65 PE

(58) Field of Classification Search ..... 123/65 P, 123/65 PE, 73 PP
See application file for complete search history.

(56) References Cited

U.S. PATENT DOCUMENTS 4,549,507 A * 10/1985 Baumhardt ..... 123/59.7
4,559,908 A * 12/1985 Flaig et al. ..... 123/41.28
6,016,776 A * 1/2000 Jonsson ..... 123/65 A
6,019,074 A * 2/2000 Otome ..... 123/65 P
6,039,012 A * 3/2000 Motoyama ..... 123/65 PE
6,164,066 A * 12/2000 Sakaguchi et al. ..... 60/302
6,588,382 B1 * 7/2003 Uneta ..... 123/73 C
6,591,606 B1 * 7/2003 Rosskamp et al. ..... 60/302

FOREIGN PATENT DOCUMENTS

DE 19900445 7/2000

* cited by examiner

*Primary Examiner*—Stephen K. Cronin
*Assistant Examiner*—Jason Benton
(74) *Attorney, Agent, or Firm*—Robert W Becker & Associates; Robert W Becker

(57) ABSTRACT

A two-cycle engine in a portable, manually-guided implement, such as a power chain saw, a cut-off machine, a brush cutter, or the like, is provided. The cylinder has a combustion chamber that is delimited by a reciprocating piston that via a connecting rod drives a crankshaft that is mounted in a crankcase so as to be rotatable about a crankshaft axis. The cylinder has an outlet for conveying exhaust gases out of the combustion chamber, with the outlet having an axis of the channel thereof. The cylinder also has an inlet for supplying a fuel/air mixture to the crankcase. By means of at least two transfer channels, the fuel/air mixture is conveyed out of the crankcase and into the combustion chamber, with the transfer channels being disposed symmetrically relative to the axis of the channel of the outlet. When viewed in the direction of the longitudinal axis of the cylinder, the axis of the channel of the outlet is disposed at an angle of less than 90° relative to the longitudinal central axis of the crankshaft.

5 Claims, 2 Drawing Sheets

TWO-CYCLE ENGINE HAVING SCAVENGING

BACKGROUND OF THE INVENTION

The present invention relates to a two-cycle engine for a manually guided implement, such as a power chain saw, a cut-off machine, a brush cutter, or the like.

DE 199 00 445 A1, of the same assignee, discloses a two-cycle engine having scavenging. The combustion chamber that is formed in a cylinder is delimited by a reciprocating piston that, via a connecting rod, drives a crankshaft that is rotatably mounted in a crankcase. The combustion chamber is provided with an outlet for the discharge of the exhaust gases, and is also provided with gas-conveying transfer channels for the transfer of a fuel/air mixture and air for combustion into the combustion chamber. The transfer channels are disposed symmetrically relative to the longitudinal central axis of the outlet, whereby the longitudinal central axis extends in a direction perpendicular to the axis of the crankshaft.

The position of the crankshaft in the housing of the implement is predetermined by the position of the components that are to be driven, for example with a power saw by the position of the guide bar with the saw chain. Disposed at the outlet of a two-cycle engine is an exhaust gas muffler for reducing noise, and disposed at the inlet is an air filter and a carburetor. The arrangement of these components in the housing of the implement is determined in conformity with the spatial position of the inlet and the outlet of the two-cycle engine, since the components are disposed essentially directly at the inlet and the outlet. In particular with power saws, the exhaust gas muffler that is connected to the outlet, and the carburetor that is connected to the inlet, determine the overall length of the housing of the implement in the longitudinal direction of the guide bar.

It is an object of the present invention to further improve a two-cycle engine of the aforementioned general type in such a way that it is possible to mount the operating components with flexibility in respect to the position thereof.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The object of the invention is realized with a two-cycle engine of the aforementioned general type that furthermore includes an inlet that supplies to the crankcase a fuel/air mixture that is conveyed via at least two transfer channels from the crankcase to the combustion chamber, whereby a respective transfer channel is respectively disposed on each side of an axis of a channel of the outlet, and in particular is disposed symmetrically relative to such axis; when viewed in a direction of the longitudinal axis of the cylinder, the axis of the channel of the outlet forms, with the longitudinal central axis of the crankshaft, an angle that is less than 90°.

As a consequence of the angle of less than 90° between the axis of the channel of the outlet, and a longitudinal central axis of the crankshaft, when viewed in plan the axis of the channel of the outlet is no longer perpendicular to the longitudinal central axis. Therefore, an exhaust gas muffler that is disposed at the outlet is no longer perpendicular to the longitudinal central axis of the crankshaft, but rather can be shifted by an angle relative to this old position. The installation space required by the exhaust gas muffler can thus be flexibly adapted to the installation conditions of the housing and to other components. There thus results a better utilization of space in the housing of the implement. The relative position of the transfer channels and the outlet to one another is not changed, so that the scavenging pattern itself also remains unchanged. Due to the rotated arrangement of the channels, there is now also the possibility for disposing the carburetor in the housing in such a way that there is adequate space for additional air channels, for example in order to transform the technology of the scavenging with clean air or charge stratifying.

When viewed in the direction of the longitudinal direction of the cylinder, the axis of the channel of the inlet expediently forms with the axis of the channel of the outlet an angle $\beta$ that is somewhat greater than 0°. An expedient value is between 2° and 20°. In this way, the position of the carburetor disposed at the inlet can be flexibly adapted to the installation conditions without changing the position of the other channels.

Further specific features of the present invention will be described in detail subsequently.

DESCRIPTION OF PREFERRED EMBODIMENTS

Figure 1:
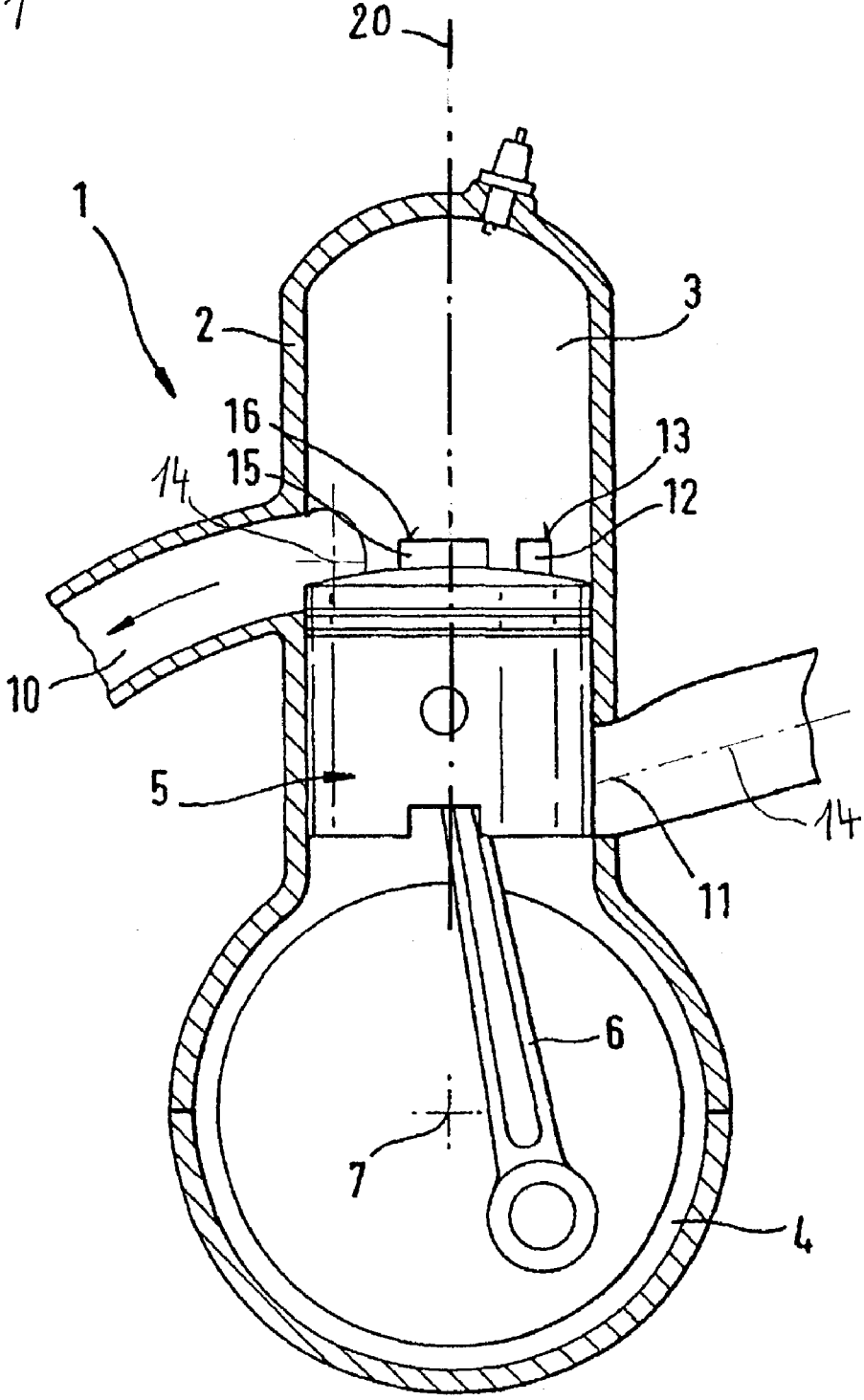
FIG. 1 is a cross-sectional view of a two-cycle engine having four transfer channels.

Referring now to the drawings in detail, FIG. 1 shows a cross-section through a two-cycle engine 1 along the longitudinal axis 20 of the cylinder 2 perpendicular to the longitudinal central axis 8 (FIGS. 2 and 3) of the crankshaft 7. Formed in the cylinder 2 of the two-cycle engine 1 is a combustion chamber 3 that is delimited by a reciprocating piston 5. By means of a connecting rod 6, the piston 5 drives the crankshaft 7, which is rotatably mounted in the crankcase 4. Opening into the crankcase 4 is the inlet 11, via which a fuel/air mixture is supplied to the crankcase 4 from a carburetor. During the downward movement of the piston 5 the fuel/air mixture is compressed in the crankcase 4. As soon as the inlet windows 13 and 16 are released by the piston 5, the fuel/air mixture flows into the combustion chamber 3 via the transfer channels 12 and 15. The fuel/air mixture is compressed in the combustion chamber 3 during the subsequent upward movement of the piston 5, and is ignited in the region of the upper dead center position. As a consequence of the combustion, the piston 5 is forced downwardly. The exhaust gases leave the combustion chamber 3 via the outlet 10, which is opened by the piston 5.

The axis 14 of the channel of the outlet 10, which can be the central axis of symmetry of the outlet, is not, when viewed in the direction of the longitudinal axis 20 of the cylinder 2, disposed at a right angle to the crankshaft 7, but rather forms with the longitudinal central axis 8 of the crankshaft 7 an angle $\alpha$ that is less than 90°. The angle $\alpha$ is expediently approximately 15° to 85°, preferably approximately 60°. Thus, the position of an exhaust gas muffler that is connected to the outlet 10 can be varied relative to the cylinder, and can be disposed in an optimum position in a housing.

In the embodiment illustrated in FIG. 1, the inlet 11 and the outlet 10 are approximately coaxial with one another, so that when viewed in the direction of movement of the piston 5, the axis 14 of the channel of the outlet 10, and the axis 9 of the channel of the inlet 11, have the same direction.

Figure 2:
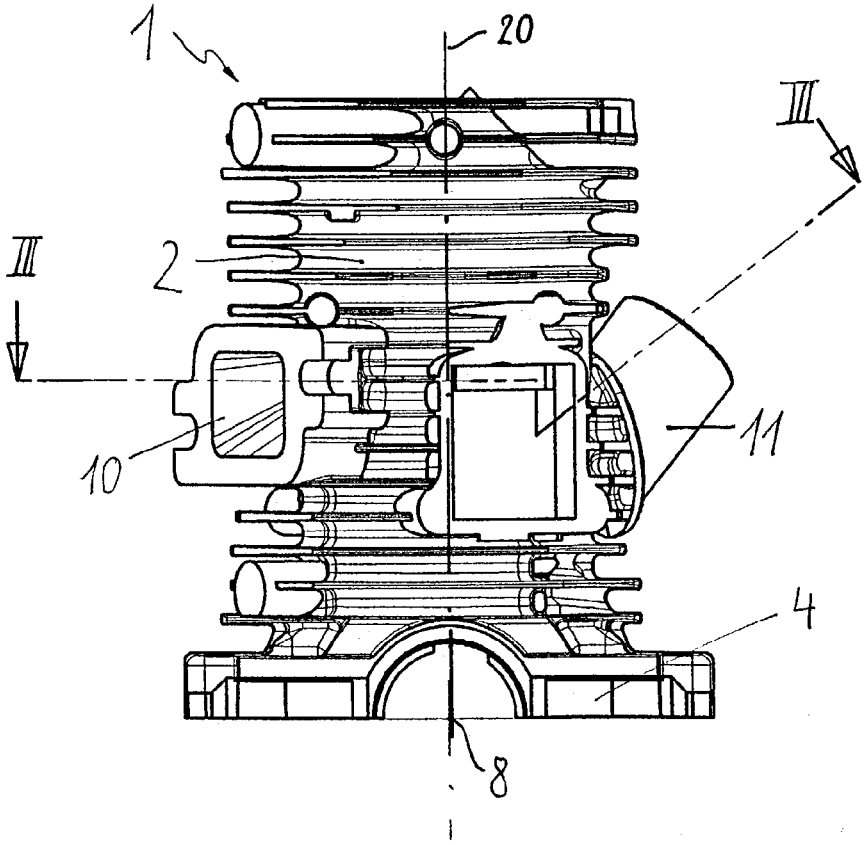
FIG. 2 is a side view of a modified cylinder of a two-cycle engine of FIG. 1 with a crankcase half formed thereon.
Figure 3:
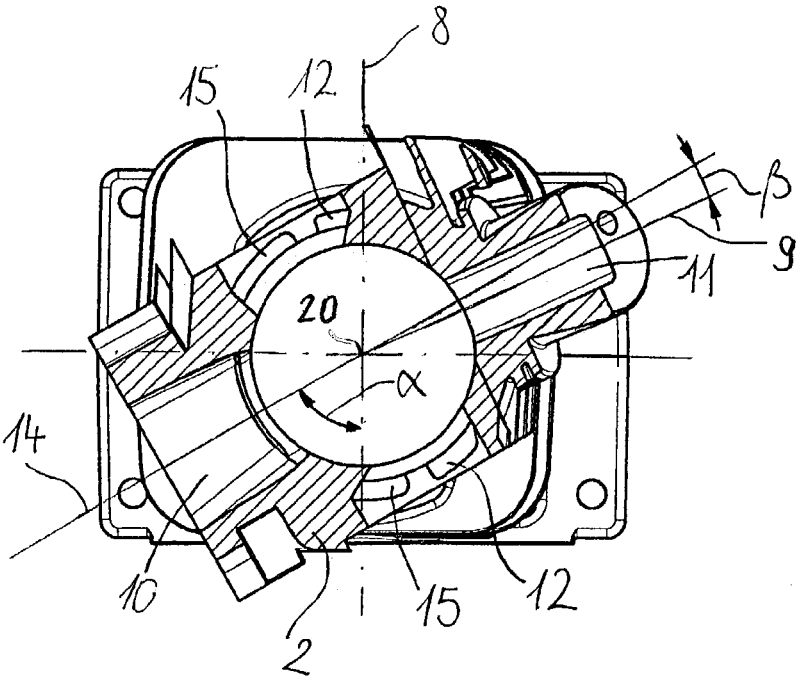
FIG. 3 is a cross-sectional view taken along the line III—III in FIG. 2.

In the embodiment of FIG. 2, a cylinder 2 is illustrated in a side view with a formed-on lower half of the crankcase 4. The same components as in FIG. 1 are indicated by the same reference numerals. The cross-sectional view taken along the view III—III is illustrated in FIG. 3. As viewed in the direction of the longitudinal axis 20 of the cylinder 2, the axis 14 of the channel of the outlet 10 is rotated relative to the longitudinal central axis 8 of the crankshaft 7 by an angle $\alpha$ that is less than 90°, for example 60°. Furthermore, as viewed in the direction of the longitudinal axis of the cylinder 2, the axis 9 of the channel of the inlet 11 is rotated, in either direction of rotation, relative to the axis 14 of the channel of the outlet 10 by an angle $\beta$ that can be approximately 2° to 20°, in particular 5°. If when viewed in the direction of the longitudinal axis 20 of the cylinder 2 the axis 9 of the channel of the inlet 11, and the axis 14 of the channel of the outlet 10, approximately coincide or are coaxial with one another, the transfer channels 12 and 15 are symmetrical to the axis 14 of the channel of the outlet 10, so that when viewed in plan a channel image results that is symmetrical to the outlet 14 of the channel.

The specification incorporates by reference the disclosure of German priority document 102 01 967.3 filed 19 Jan. 2002.

The present invention is, of course, in no way restricted to the specific disclosure of the specification and drawings, but also encompasses any modifications within the scope of the appended claims.

We claim:

1. A two-cycle engine for a portable, hand-guided implement, comprising:

a cylinder in which is formed a combustion chamber, wherein said cylinder is provided with an outlet for conveying exhaust gas out of said combustion chamber, and with an inlet for supplying a fuel/air mixture to a crankcase, wherein at least two transfer channels are provided for conveying said fuel/air mixture from said crankcase to said combustion chamber, wherein at least one of said transfer channels is respectively disposed on each side of an axis of a channel of said outlet; and a piston that reciprocates in said cylinder in the direction of a longitudinal axis thereof and that delimits said combustion chamber, wherein said piston, via a connecting rod, drives a crankshaft that is rotatably mounted in said crankcase, and wherein, when viewed in a direction of said longitudinal axis of said cylinder, said axis of said channel of said outlet forms, with a longitudinal central axis of said crankshaft, an angle that is less than or equal to 85°, wherein an axis of a channel of said inlet forms with said axis of said channel of said outlet an angle when viewed in the direction of said longitudinal axis of said cylinder, and wherein said angle of said axis of said channel of said inlet is approximately 2° to 20°.

2. A two-cycle engine according to claim 1, wherein said angle of said axis of said channel of said outlet is approximately 40° to 80°.

3. A two-cycle engine according to claim 2, wherein said angle of said axis of said channel of said outlet is 60°.

4. A two-cycle engine according to claim 1, wherein an axis of a channel of said inlet coincides approximately with said axis of said channel of said outlet when viewed in the direction of said longitudinal axis of said cylinder.

5. A two-cycle engine according to claim 1, wherein said angle of said axis of said channel of said inlet is 5°.

* * * * *